United States Patent [19]

Scully

[11] Patent Number: 4,571,926

[45] Date of Patent: Feb. 25, 1986

[54] APPARATUS FOR FORMING, FILLING AND DEPOSITING FILLED BAGS INTO CARTONS

[75] Inventor: John W. Scully, Raynham, Mass.

[73] Assignee: Pneumatic Scale Corporation, Quincy, Mass.

[21] Appl. No.: 374,002

[22] Filed: May 3, 1982

Related U.S. Application Data

[63] Continuation of Ser. No. 50,973, Jun. 22, 1979, abandoned.

[51] Int. Cl.[4] ..... B65B 1/22; B65B 9/10

[52] U.S. Cl. ..... 53/525; 53/170; 53/552; 53/260

[58] Field of Search ..... 53/437, 451, 449, 525, 53/551, 552, 554, 170, 171, 173, 250, 255, 260

[56] References Cited

U.S. PATENT DOCUMENTS

| | | | |
|---|---|---|---|
| 3,054,238 | 9/1962 | Crane | 53/255 |
| 3,369,339 | 2/1968 | Speiser | 53/260 X |
| 3,426,502 | 2/1969 | Greenberg | 53/374 X |
| 3,479,795 | 11/1969 | Martin | 53/250 X |
| 3,602,107 | 8/1971 | Zimmer et al. | 53/374 X |
| 3,983,682 | 10/1976 | Scully | 53/525 |
| 4,040,235 | 8/1977 | Chlipalski | 53/540 X |
| 4,084,390 | 4/1978 | Schmachtel et al. | 53/171 X |
| 4,124,967 | 11/1978 | Beer et al. | 53/250 X |
| 4,137,830 | 2/1979 | Boyd | 53/250 X |
| 4,215,520 | 8/1980 | Heinzer et al. | 53/173 |

FOREIGN PATENT DOCUMENTS

| | | |
|---|---|---|
| 1191295 | 5/1970 | United Kingdom . |
| 1228901 | 4/1971 | United Kingdom . |
| 1499817 | 2/1978 | United Kingdom . |
| 1531023 | 11/1978 | United Kingdom . |

*Primary Examiner*—Horace M. Culver

*Attorney, Agent, or Firm*—Robert T. Gammons

[57] ABSTRACT

Apparatus for forming, filling and depositing filled bags into cartons wherein the portions of the tube which are to become bags upon sealing and severing are suspended in a forming device above a conveyor for vibration to conform the cross section of the bags to the cross section of the forming device at a height such that the lower end of the forming device is above the upper end of the cartons resting on the conveyor and that filled cartons can be moved away from the lower end of the forming device and empty cartons moved into position below the forming device while a bag is being vibrated, wherein there is a conveyor for moving the cartons in timed relation to the release of the bags from the forming device and means for venting the cartons while the bags are being deposited therein.

4 Claims, 14 Drawing Figures

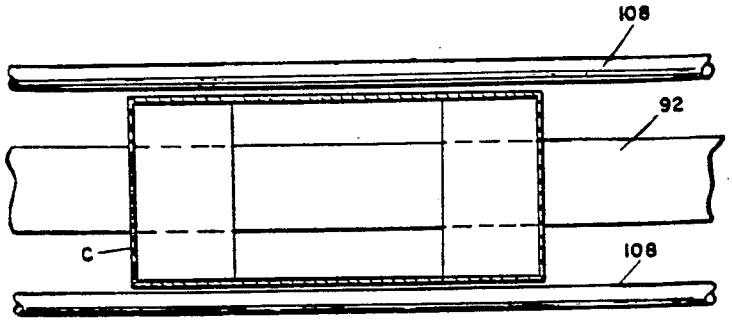
Fig. 7
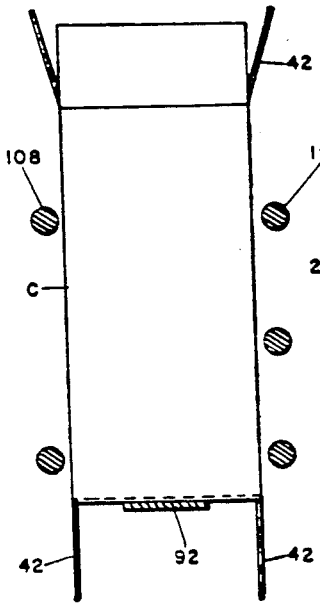
Fig. 9
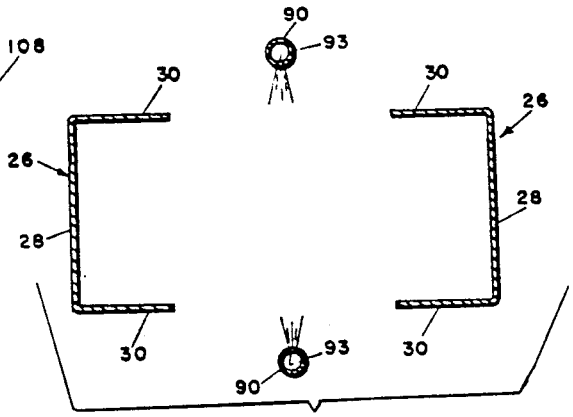
Fig. 2-A

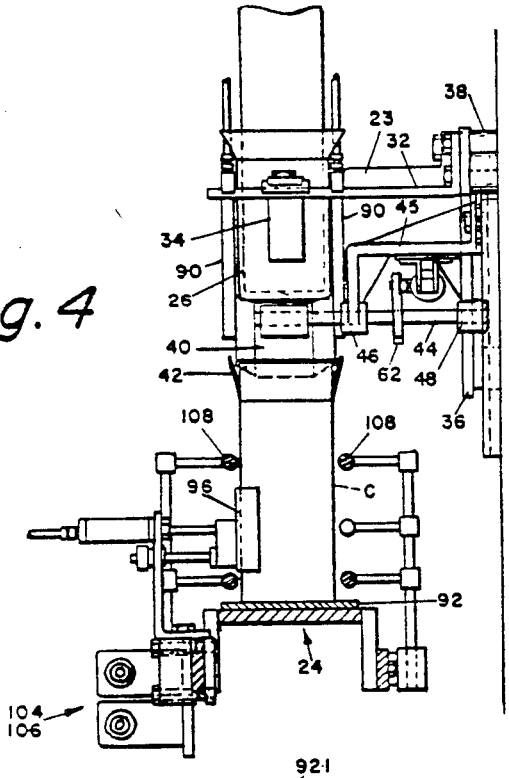
Fig. 4
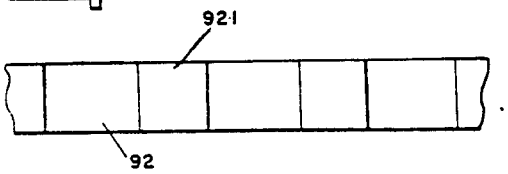
Fig. 4-A

APPARATUS FOR FORMING, FILLING AND DEPOSITING FILLED BAGS INTO CARTONS

BACKGROUND OF THE INVENTION

This is a continuation of application Ser. No. 050,973 filed June 22, 1979, now abandoned, entitled APPARATUS FOR FORMING, FILLING AND DEPOSITING THE FILLED BAGS INTO CARTONS.

U.S. Pat. No. 3,983,682 deals with forming, filling and depositing bags filled with a particulate material into cartons and to facilitate the introduction of the filled bags into the carton, guide means comprising a pair of opposed channel members is employed within which the filled bags are conformed while suspended therein by vibrating the guide means. The guide means extends into the open upper end of the carton so that each filling operation has to be completed and the filled carton moved away before the next filling operation can be started, thus limiting the speed of operation. Further, after a bag was released and allowed to drop into a carton, its rate of descent was retarded by its frictional contact with the guide means and the cushioning effect of the air within the carton which prevented the bag from dropping quickly into the carton. The apparatus herein is designed especially to rectify these limitations in the aforesaid machine and as designed herein increases the rate of cartoning by about 60%.

SUMMARY OF THE INVENTION

As herein illustrated, the apparatus comprises a hollow, vertically-disposed mandrel on which sheet material is formed into a continuous tube, sealing means situated below the mandrel for at times sealing the tube transversely, means for filling a portion of the tube above the transverse seal, conveyor means situated below the sealing means in alignment with the mandrel for moving cartons in succession to a position below the sealing means for receiving filled bags, a tubular forming device situated below the sealing means between the sealing means and the conveyor means with its upper end adjacent the underside of the sealing means and its lower end above the conveyor means at a level above the upper ends of the cartons resting on the conveyor means, said sealing means being located high enough above the conveyor means so that the bottom of a bag suspended thereby within the forming means is above the open top of a carton resting on the conveyor means, means for moving the portion of the tube above the sealing means which have been filled to a position below the sealing means suspended within said forming device, said forming device being of a length to receive the filled portion of the tube moved to said position below the sealing means for forming it to the cross section of the forming device, means for vibrating the forming device to effect conformation of the suspended portion of the tube to the cross section of the forming device, means for severing the suspended tube above the fill to form a gag, and releasing it so that it drops into the carton, and means for effecting movement of the conveyor to present an empty carton to a position below the forming means in timed relation to the release of the filled bag. The sealing means seals a longitudinal portion of the tube and the severing means severs the tube within the sealed area between the portion of the tube above the suspended portion of the tube below the sealing means to form a bag closed at the top and to release the bag so that it drops from the forming device into the carton supported therebelow. There is means for effecting movement of the conveyor means and means operable in synchronism with the means for releasing the bag to stop a carton in a position to receive the filled bag and thereafter to move it on. The aforesaid means may comprise indexing means for moving the conveyor intermittently. There is means for varying the cross section of the forming device and there are retractable deflectors at the lower end of the forming device, and means for moving them into positions to fold the closure flaps at the upper end away from the top of the carton to permit the bag to fall freely into the carton and means for projecting jets of air downwardly against the front and back sides of the bag suspended in the forming device to assist in releasing the bag from the forming device when it is severed. There is also means for venting the cartons during deposit of the bags therein comprising employing a forming device having a cross-sectional area somewhat less than the cross-sectional area of the carton so that the filled bag will be conformed to a cross section slightly smaller than the cross section of the carton. Alternatively, the means for venting the cartons comprises providing vent openings at the lower ends of the cartons and after depositing the bags in the cartons, closing the vent openings.

In another aspect, the invention comprises a method of packaging particulate material in flexible bags and depositing them in cartons comprising forming a length of flexible material into a tube, sealing the tube transversely, filling a portion of the tube above the seal with a predetermined charge of particulate material, lowering the filled portion of the tube into a forming device of a predetermined cross section to a position in which its lower end is spaced above the open top of a carton, and while holding it suspended therein, effecting vibration to cause it to conform to the cross section of the forming device. During vibration, a previously filled carton is moved away from the lower end of the forming device and an empty carton is moved into a position below the forming device into alignment with the lower end of the bag suspended within the forming device. The method includes simultaneously sealing and severing the bag in a sealed area to form a closed top bag, projecting jets of air downwardly against the front and back sides of the bag while in the forming device to release it from the forming device and of venting the carton during deposit of the bag into the carton either by forming the bag while suspended to a cross section somewhat less than the cross section of the carton or providing a vent opening at the bottom of the carton.

The invention will now be described in greater detail with reference to the accompanying drawings, wherein:

FIG. 2A is a horizontal section of the forming means showing the blowdown means;

FIG. 4 is a partial elevation from the right side of the apparatus as shown in FIG. 3;

FIG. 4A is a fragmentary plan view of a conveyor belt designed to convey cartons in uniformly-spaced relation.

FIG. 7 is a plan view of a narrow conveyor belt for transporting cartons with the end or dust flaps folded up and both of the sides or closure flaps folded down;

FIG. 9 is a vertical section taken transversely of FIG. 7 showing a carton resting on the belt with the end or dust flaps folded up and both of the side closure flaps folded down;

Figure 1:
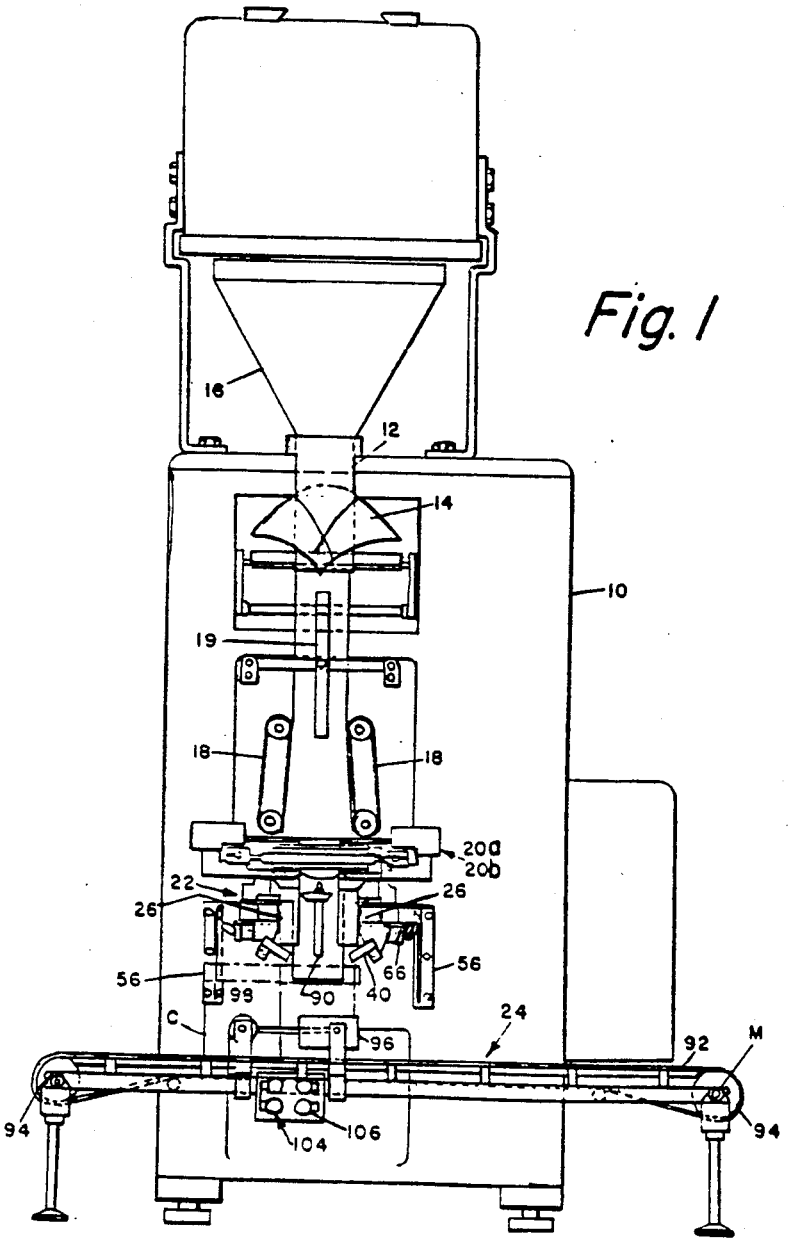
FIG. 1 is a front elevation of a vertical forming and filling machine according to this invention.
Figure 2:
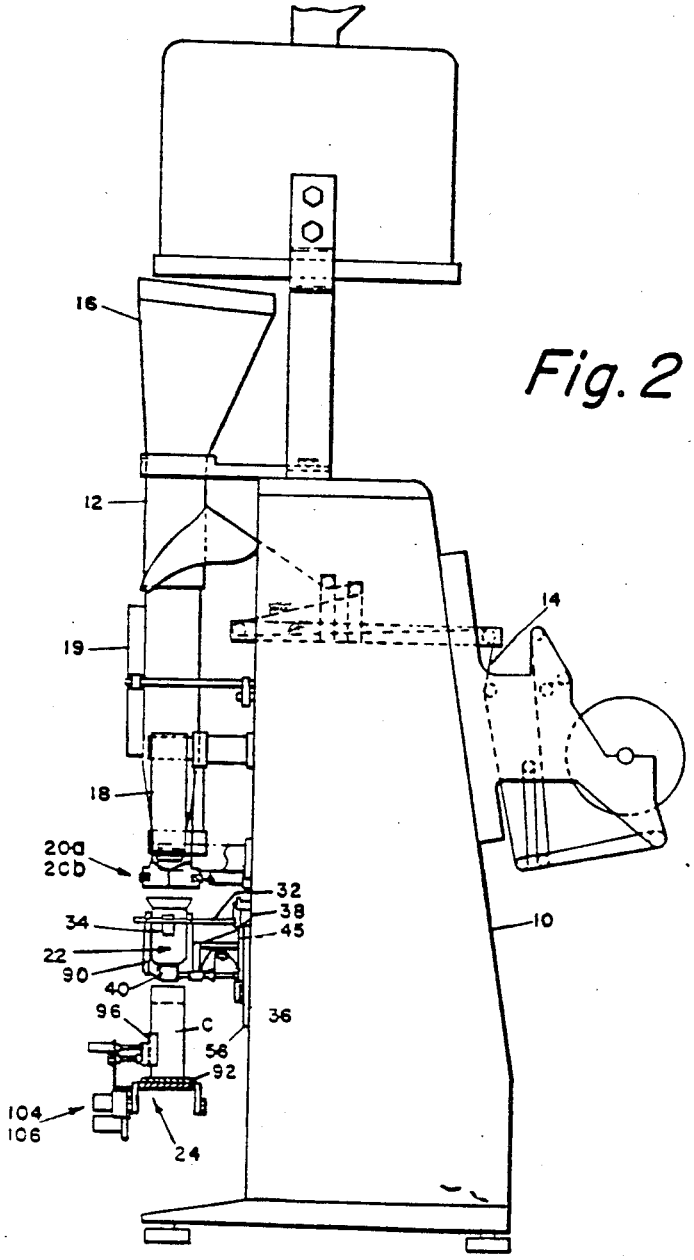
FIG. 2 is a side elevation as seen from the right side of FIG. 1.

Referring to the drawings, FIGS. 1 and 2, the apparatus of this invention is a vertical type forming and filling machine comprising a frame 10 on which there is vertically supported a hollow filling mandrel 12 to which there is supplied flexible sheet material 14 for forming into a continuous tube on the mandrel and above which there is supported a hopper 16 for supplying material to be packaged; a side sealing element 19 for continuously forming a side seam; means 18—18 for moving the formed tube downwardly on the mandrel; sealing and severing means 20*a*, 20*b* for forming the tube into bag lengths and separating the bag lengths into individual bags; a tubular forming device 22 for conforming the cross section of the bags to the interior cross section of the cartons in which they are to be deposited, including means 23 for vibrating the forming device; and conveyor means 24 for moving cartons into positions for receiving the bags and thereafter moving them on.

Figure 5:
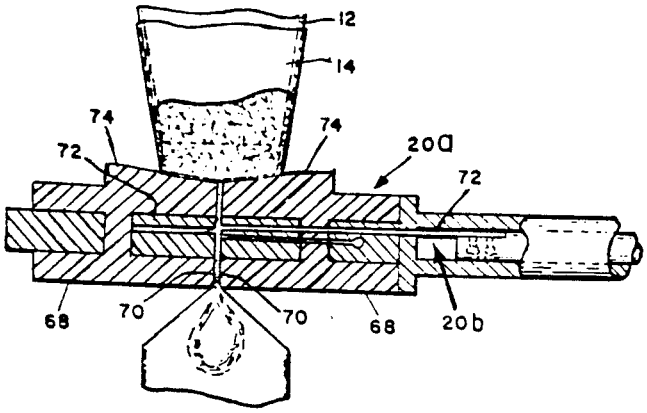
FIG. 5 is a fragmentary section of the sealing and severing means.

The sealing means 20*a* comprises, FIG. 5, a pair of opposed jaws 68—68 supported for horizontal reciprocation toward and from each other whch have vertically-disposed flat surfaces 70—70 for engagement with the front and back sides of the tube to press them together to seal a narrow length of the tube as shown in FIG. 5 from the top to the bottom of the faces of the jaws. The jaws have a vertical depth which is sufficient to form a sealed area which is adapted to be severed intermediate its upper and lower boundaries to form a seal at the lower end of the bag above the jaws and a seal at the upper end of the bag below the jaws.

The severing means 20*b* comprises cutting blades 72—72 which are recessed into the jaws 68—68 for horizontal movement, after the jaws are brought together, to cut through the sealed area. When a structure of this kind is employed, as soon as the jaws are retracted, the bag at the lower side of the jaws is released, whereupon it drops from the forming device into the carton.

Figure 5A:
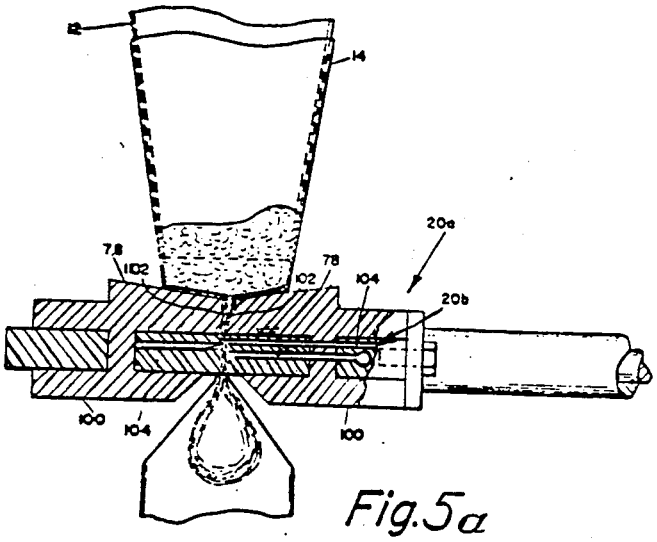
FIG. 5A is a section similar to FIG. 5 showing the sealing jaws cut away below the cutting blades.
Figure 10:
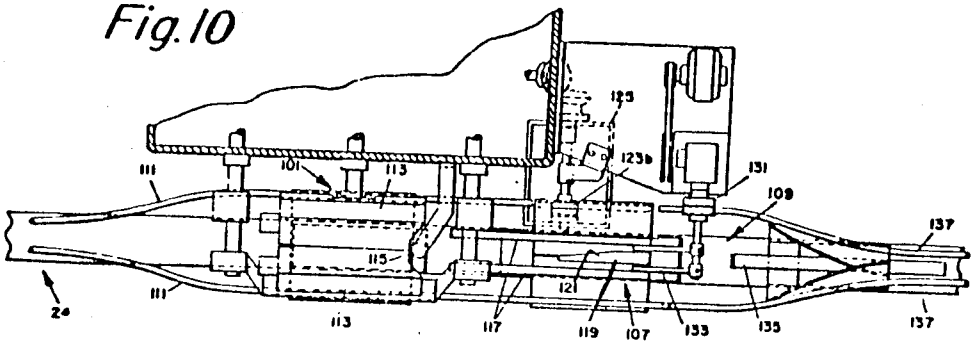
FIG. 10 is a plan view of the means for sealing the tops of open top bags.
Figure 11:
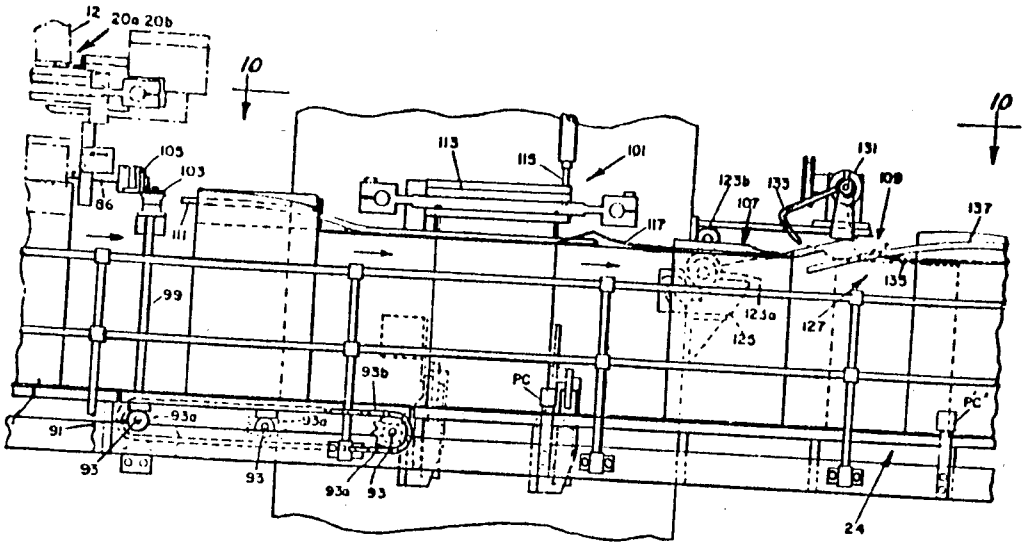
FIG. 11 is an elevation of FIG. 10.

It may be desirable under certain circumstances to leave the top of the bag below the jaws open until it is deposited in the carton and if this is the case the lower portions of the jaws 68—68 below the cutting blades 72—72 are beveled as shown in FIG. 5A so that the seal takes place only above the cutting blades. The tube below the cutting blades is not sealed and so the bag length formed by severing the tube remains open at the top and will drop downwardly through the guiding means into the carton. When operating in this fashion there is provided means 101 as shown in FIGS. 10 and 11 for sealing the upper open ends of the bags while within the cartons after the latter are moved away from the lower end of the mandrel by the conveyor 24.

The sealing jaws 68—68 are provided at their upper sides, FIG. 5, with flat surfaces 74—74 upon which the lower end of the bag at each side of the seam is adapted to rest during the filling operation and the operation of the apparatus is designed to hold the sealing jaws 68—68 engaged with the bottom seam until the bag is completely filled and for a sufficient length of time to perfect the seal by allowing it to become set before the sealing jaws are retracted to permit the bag to be dropped down for deposit into the carton therebelow. The advantage, as pointed out, was to form a bag of uniform cross section throughout its length. This provided for a maximum fill volume and maximum bag length even when the bottom seal was of the pillowslip type.

After the tube is sealed transversely to form the bottom of a bag, and the portion above the sealed portion is filled with a predetermined amount of particulate material, the tube is lowered to position the filled portion within the tubular forming device 22, the cross section of which corresponds substantially to the inside cross section of the carton within which the bag is to be deposited and while suspended therein is vibrated to conform it to the interior of the carton whereupon it is severed from the portion of the tube above it and allowed to gravitate into the carton resting on the conveyor.

In the aforesaid patented apparatus, the lower end of the forming device 22 extends into the open part of the cartons and must be raised to permit a filled carton to be moved away. Hence, the speed of operation is limited, thus slowing up the rate of production. Furthermore, the conforming of the bags to the exact cross section of the interior of the cartons traps air within the cartons during deposit of the bags therein, thus preventing the bags from settling immediately to the bottom and thus limiting the rate of cartoning. Failure of the bags to settle rapidly to the bottom of the cartons was also aggravated by frictional contact of the surface of the bags with the inner sides of the cartons. In order to overcome these problems, the forming device of the apparatus of this invention is raised or the conveyor is lowered so that the open upper end of cartons standing on the conveyor are spaced below the lower end of the forming device so that the bottoms of bags suspended in the forming device are also spaced above the open top of the carton. Additionally, blowdown means is provided for disengaging the bags from the forming device and means is provided for venting the cartons as the bags are dropped into the cartons.

The forming device 22 as herein illustrated comprises a pair of confronting channel members 26—26 which are supported below the sealing and severing means and above the open tops of the cartons resting on the conveyor 24 therebelow. Each channel member 26, FIG. 2A, has a side wall 28 and right angularly disposed front and back walls 30—30 for engagement with front, back and side walls of the filled bag. The channels 26—26 are supported between the forward ends of a pair of transversely-spaced horizontal arms 32—32 by L-shaped bracket members 34—34, the vertical arms of which are fixed to the channel members and the horizontal arms of which are adjustably fastened to the forward ends of the arms 32—32 for movement transversely thereof, thus enabling changing the spacing of the channel members and, hence, the cross-sectional area defined by the channel members. The rear ends of the arms 32—32 are secured to a mounting panel 36 with relatively thick blocks 38—38 of rubber-like material between them and the frame. As thus supported, the upper end of the forming device is just below the lower side of the sealing and severing means and the lower end is situated above the conveyor means at a level which is above the upper ends of the carton resting on the conveyor means. There are at the lower end of the forming device at opposite sides pivotally-mounted deflector elements 40—40 arranged to be lowered into the open end of a carton supported therebelow for holding the closure members 42—42 at the top of the carton deflected outwardly from the top and to guide the bag into the open end of the carton. The deflector members 40—40 are pivotally mounted on shafts 44—44 and these, in turn, are rotatably mounted to the frame of the machine by bracket members 45—45 provided with bearings 46—46, 48—48. The brackets 45—45 are fastened by bolt and slot means 50—50, 52—52 to a cross bar 54 for movement transversely toward and from each other and the opposite ends of the bar 54 are connected to vertically-disposed posts 56—56 by bolts 58—58 extended through slots 60—60 which provide for adjustment of the deflector members up and down. The deflector members 40—40 are moved into and out of operative positions by rotation of the shafts 44—44 and rotation of the shafts 44—44 is effected by arms 62—62 fixed at one end to the shafts and connected at their other ends to the piston rods 64—64 of air cylinders 66—66. The deflectors are held retracted until a carton is moved into position and are immediately withdrawn when the bag drops into the carton.

In order to conform the filled bag with the cross section of the forming device, the latter is vibrated while the bag is suspended therein and while the portion of the tube above the sealing and severing means is being filled. Vibration of the forming device is effected herein by the vibrator 23 which is bolted to the mounting panel 36. As previously mentioned, the panel is secured to the frame with rubber blocks between it and the frame so that substantial shaking of the panel and, hence, of the forming device can be achieved.

In accordance with one aspect of this invention, as previously explained, the lower end of the forming device is located at a sufficient distance above the conveyor so that cartons can be moved into and out of position below the lower end of the forming device while a filled bag is suspended within the forming device and the portion of the tube above the sealing and severing means is being filled. Thus, it is possible to speed up the cartoning operation by moving cartons into and out of loading position without having to await retraction of the forming device.

Figure 8:
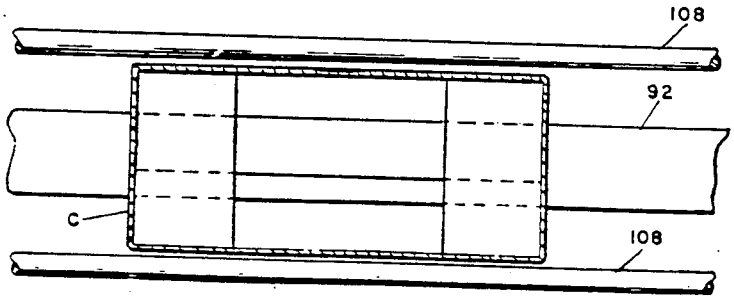
FIG. 8 is a plan view of a narrow conveyor belt for transporting cartons with the end or dust flaps and one side flap folded up and one side closure flap folded down.
Figure 6:
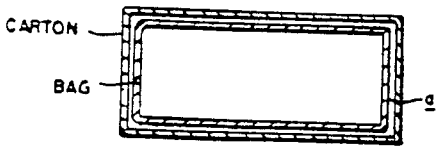
FIG. 6 is a horizontal section through a carton showing a clearance space between the bag and the carton which provides one form of venting.

Ideally, as previously related, the forming means 22 is provided with a cross section which corresponds substantially with the cross section of the interior of the carton so that a bag which is conformed to the forming device will slide smoothly into the open top of the carton. As a practical matter, however, it is desirable to make the cross section of the forming device somewhat smaller than the cross section of the interior of the carton and this is achieved by the adjustable mounting of the channel-shaped members 26—26 constituting the forming device relative to each other. Reduction of the cross section of the forming device and, hence, of the bag before it is dropped therefrom into the carton provides a narrow clearance space a, FIG. 6, around the bag between it and the carton so that frictional engagement of the sides of the bag with the inner side of the carton is avoided which, as has been found, tends to retard the movement of the bag into the carton. At the same time, the air trapped between the bottom of the bag and the bottom of the carton which tends to prevent the bag from descending freely into the carton can escape upwardly around the bag. The venting of the carton may be achieved by bottom venting as shown in FIGS. 7, 8 and 9. In FIGS. 8 and 9, the belt 92 is made narrow and the carton is placed on the belt with the end or dust flaps resting on the belt and the side or closure flaps turned down. The space between the adjacent ends of the dust flap provides for venting. As shown in FIG. 9, the carton is placed on the belt with the dust flaps and one of the closure flaps resting on the belt and the other closure flap turned down. The space between the dust flaps exposed by the downwardly-folded closure flap provides for venting.

The slight reduction in the cross section of the bag to eliminate frictional contact with the inside of the carton, the provision of a vent space around the bag and the provision of a vent hole at the bottom of the carton collectively promote rapid descent of the bag into the carton which thus enables increasing the rate of cartoning so that it can be accomplished within the time period required for depositing the particulate material in the bag above the sealing and severing means so that the speed of cartoning is limited only by the rate at which the bag can be filled with the particulate material. This is especially important when filling bags with particulate material which is lightweight bulky material, the descent of which is retarded both by the effects of friction and the buoyancy of air trapped within the carton as it descends into the carton.

The frictional contact of the filed bags with the inside of the forming device 22 sometimes inhibits free descent of the filled bag. Hence, there is provided, FIG. 2A, blowdown means at the front and back in the form of vertically-disposed tubes 90—90 located in the space between the channel members which contain vertically-spaced, downwardly-inclined ports 93—93 through which jets of air are ejected downwardly against the front and back sides of the bag.

Figure 3:
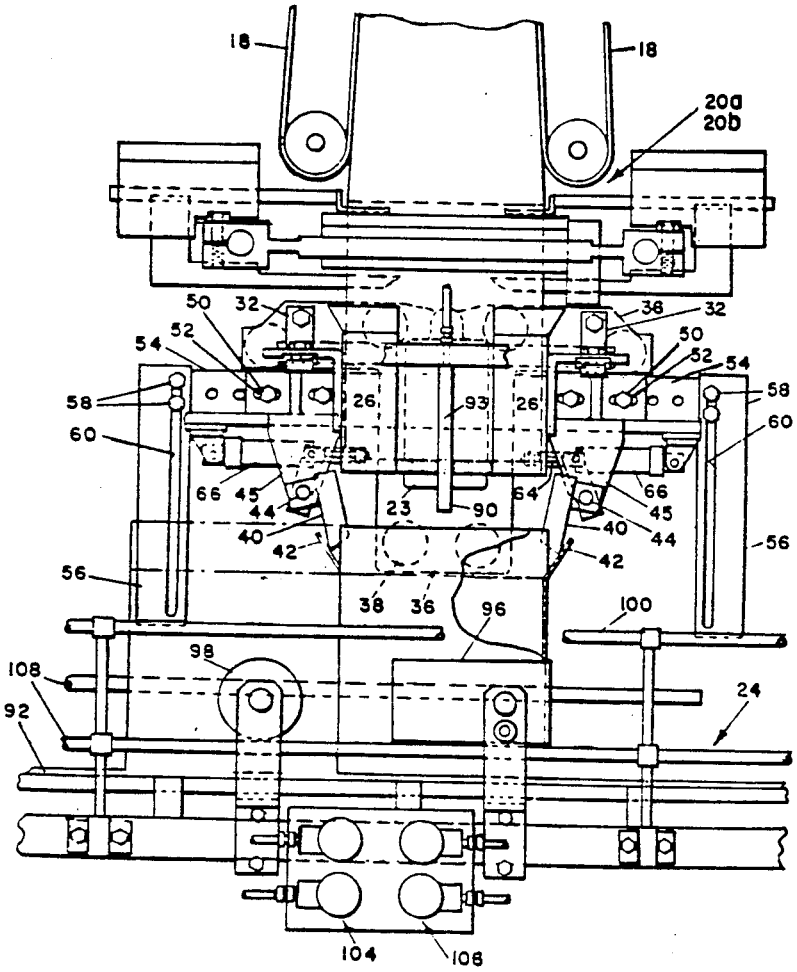
FIG. 3 is an enlarged fragmentary front elevation of the machine showing the forming device for conforming the filled bags to the cross section of the carton and for guiding the filled bags into the cartons and further showing the conveyor for supporting the cartons below the forming device for deposit of the bags in the cartons.

The conveyor 24 which moves the empty cartons into position beneath the forming device and removes the filled cartons in one form comprises a belt 92, FIGS. 3 and 4, supported with a portion in a horizontal position on longitudinally-spaced sprockets 94—94, FIG. 1; the sprockets at one end being driven through suitable connections by a motor M continuously or intermittently. When driven continuously, there is provided a positioning device 96 which is automatically moved into a position across the conveyor to stop a carton directly below the forming device in synchronism with the operation of the means for severing the bag so that the carton will be in a position when the bag is released to receive the bag. A stop 98 is moved across the conveyor to press the carton against the railing at the back side of the conveyor to stop the succeeding carton. Pneumatic means are provided for operating the positioning device and stop to which air is supplied by valve means 104,106. Alternatively, the belt may be moved intermittently with the aid of indexing means to move cartons one at a time into position below the forming device. When using indexing means, the belt is provided with means for holding the cartons at uniformly-spaced intervals. For example, the conveyor may comprise, FIG. 4A, a belt 92 with longitudinally-spaced spaces 92.1 spaced apart to receive the cartons and hold them at a predetermined spacing. There are at opposite sides of the conveyor in whatever form vertically-spaced railings 108—108 for guiding the cartons and preventing them from tipping over.

When the bags are left open at the top until deposited into the carton there is provided as heretofore mentioned, sealing means 101 for sealing the open ends, means 107 for folding the sealed ends into the carton and means for closing the end and side closure flaps of the carton, FIGS. 10 and 11. Referring to FIGS. 10 and 11, as a carton with a bag in it is moved by the conveyor 24 away from the lower end of the forming and filling apparatus to the right as shown in FIG. 11, the front and back closure flaps are spread apart by spaced, parallel folding rails 111—111. The sealing means 101 comprise jaws 113—113 similar to those disclosed in FIGS. 5 and 6A arranged to reciprocate in a horizontal plane above the top line of the containers moving along on the conveyor. The open tops of the bags will be moved between the separated jaws and at the right time a detector in the form of a photocell PC causes the jaws to be closed on the upwardly projecting top of the bag to seal the top. As the jaws come together they push the end wall closure flaps apart and to hold the leading closure flap displaced downwardly, when the jaws are retracted, there is provided a pneumatic plunger 115 which is depressed into engagement with the leading flap, as shown in FIG. 11, to a nearly horizontal position so that as the carton continues to be moved along the leading closure flap it will be engaged with the underside of spaced rails 117—117 and be held down. A folding blade 119 having an inclined edge 121, supported above the line of travel of the upper ends of the carton provides for folding the upwardly projecting sealed top of the bag over so as to lie flat within the open top of the carton. Simultaneously, adhesive is applied to the lower side of the closure flap at the back of the carton by means comprising a pair of rollers **123*a*, 123*b* and a pot 125 which supplied adhesive to the lower one of the rolls 123*a*. Beyond the folding adhesive applying means there is means 127 for engaging the underside of the leading flap to cause it to be folded back and down over the top of the carton. At this point, the forward end of the carton intercepts another photocell P'C' and a one revolution clutch 131 actuated by a solenoid moves a hook 133 under the trailing closure flap and folds it forwardly and down over the open top of the carton so that both the leading flap and the trailing flap row move under a rail 135. Further movement of the carton brings the front and back closure flaps into engagement with spaced folding rails 137—137** which operate to first fold the adhesive-coated back closure flap inwardly over the end flaps and then the front closure flap onto the upper adhesive-coated side of the back closure flap.

For folding and sealing the downwardly-folded closure member or members at the bottoms of the cartons, adhesive is applied to the downwardly-folded closure member or members with adhesive-applying means such as described above, and the cartons are moved onto folding rails such as described above below a hold down rail for folding the closure member or members upwardly against the bottom.

During a single cycle of operation, a bag is formed above the sealing jaws, closed at its lower end and open at its upper end, and a bag is formed below the sealing jaws which is closed at its lower end and may be closed or open at its upper end. The filling operation takes place while the sealing jaws are closed and the severing takes place after the sealing operation. Following filling, the sealing jaws and severing blades are retracted, the released bag allowed to drop into the carton therebelow and the filled bag lowered for sealing and severing of the succeeding bag. Vibration of the bag is effected while the bag is within the guide means. If the top of the bag is left open, then the top is sealed while in the carton as the latter is moving away from the mandrel and the closure flaps are folded over the tops of the cartons.

The several operative functions, to wit, the filling operation, the sealing and severing operations, the projection of the deflectors at the lower end of the forming device, the operation of the jets, the movement of the conveyor and the operating of the positioning means and gates are all controlled to operate in synchronism and in the proper sequence to insure that the bag is filled with a predetermined quantity of particulate material sealed and severed, vibrated for a sufficient length of time to conform the bag to the cross section of the forming device, released to be deposited in the carton and a carton moved into position in time to receive the bag as it drops from the forming device by limit switches or a punched tape or a combination of limit switches and punched tape or equivalent means.

The chief advantages of the apparatus as herein described over and above that shown in U.S. Pat. No. 3,983,682 resides in an increase in the rate of cartoning of about 60% over that possible with the patented apparatus and in the elimination of interruption by reason of a bag falling to drop freely from the forming device and/or failing to descend into the carton.

It should be understood that the present disclosure is for the purpose of illustration only and includes all modifications or improvements which fall within the scope of the appended claims.

What is claimed is:

1. Apparatus for forming, filling and depositing filled bags into cartons comprising a hollow mandrel upon which a sheet of flexible material is formed into a tube with a side seam, sealing and severing means supported below the mandrel for producing transverse seams to form bags and for severing respective bags from the tube to release the same, a stationary shape-retaining device defining a vertically-elongate passage below the sealing and severing means for constraining the filled bags to substantially the interior cross section of the cartons within which they are to be deposited, a conveyor positioned below the shape-retaining device for supporting cartons for movement into alignment with the mandrel to receive the filled bags when released and means for moving the conveyor to position cartons one-at-a-time in a position below the shape retaining device to receive a filled bag and thereafter to move the filled carton away characterized in that the shape-retaining device is situated at a level exceeding the height of the cartons into which the filled bags are to be deposited to enable moving cartons into position for filling and out of position following filling while a filled bag is suspended in the shape-retaining device, and further characterized in that there is blow-down means for ejecting jets of air downwardly against the sides of the bag within the shape-retaining device.

2. Apparatus for forming, filling and depositing filled bags into cartons comprising a hollow mandrel upon which sheet material is formed into a tube with a side seam, sealing and severing means supported below the mandrel for producing seams to form bags and for severing respective bags from the tube to release the same, a stationary shape-retaining device defining a vertically-elongate passage below the sealing and severing means for constraining the filled bags to substantially the interior cross section of the carton within which they are to be deposited, a conveyor positioned below the shape-retaining device for supporting cartons for movement into alignment with the mandrel to release the filled bags when released and means for moving the conveyor to position cartons one at a time in a position below the shape-retaining device to receive a filled bag and thereafter to move the filled carton away characterized in that the shape-retaining device is situated above the conveyor at a level exceeding the height of the cartons into which the filled bags are to be deposited to enable moving the cartons into position for filling and out of position following filling while a filled bag is supended in the forming device, further characterized in that there is means for vibrating the shape-retaining device to conform a filled bag suspended therein to the cross section of the shape-retaining device and further characterized in that there is deflector means at the lower end of the shape-retaining device arranged to be lowered into the open end of a carton supported therebelow for holding the closure members at the top of the carton deflected outwardly.

3. Apparatus for forming, filling and deposting filled bags in cartons comprising a hollow mandrel upon which sheet material is formed into a tube with a side seam, sealing and severing means supported below the mandrel for producing seams to form bags and for severing respective bags from the tube to release the same, a stationary shape retaining device defining a vertically-elongate passage below the sealing and severing means for constraining the filled bag to substantially the interior cross section of the cartons within which they are to be deposited, a conveyor positioned below the shape-retaining device for supporting cartons for movement into alignment with the mandrel to receive the filled bags when released and means for moving the conveyor to position cartons one-at-a-time in a position below the shape-retaining device to receive a filled bag and thereafter move the filled carton away, characterized in that said shape-retaining device is situated above the conveyor at a level exceeding the height of the cartons into which the filled bags are to be deposited to enable moving cartons into position for filling and out of position following filling while a filled bag is suspended in the shape-retaining device, further characterized in that there are deflector means arranged at the lower end of the shape-retaining device to be lowered into the open end of a carton supported therebelow for holding the closure members at the top of the carton deflected outwardly and further characterized in that there is blow-down means provided for ejecting jets of air downwardly against the sides of the bag within the shape-retaining device for ejecting a filled bag from the shape-retaining device into a carton resting on the conveyor therebelow.

4. Apparatus for forming, filling and depositing bags filled with product into a carton open at the top and provided with closure flaps comprising a hollow mandrel upon which a sheet of flexible material is formed into a tube with a side seam, a stationary, shape-retaining device defining a vertically-elongate passage of predetermined cross section corresponding to the cross section of the carton within which the bagged product is to be deposited, sealing and severing means situated between the lower end of the mandrel and the upper end of the shape-retaining device with its upper end closely adjacent the sealing and severing means supporting a filled length of tube in the form of a bag filled with product sealed at the top and severed from the tube above the sealing and severing means suspended below the sealing and severing means within the shape-retaining device while product is being deposited into the length of tube above the sealing and severing means, a conveyor below the lower end of the shape-retaining device for moving cartons open at the top, one at a time, to a position below the lower end of the shape-retaining device at a level such as to support the cartons with their open ends in close proximity to the lower end of the shape-retaining device with a clearance therebetween and with the lower end of the filled bag suspended within the shape-retaining device spaced above the open top of the carton, said sealing and severing means being operable following deposit of product into the tube above the sealing and severing means to release the bag filled with product sealed at the top for gravitational deposit into the carton therebelow, and means at the lower end of the shape-retaining device movable relative to the shape-retaining device into the open end of the carton following movement of a carton into position below the shape-retaining device to fold the closure flaps away from the open top to permit gravitation of the filled, sealed bag into the carton and, following deposit of the filled and sealed bag into the carton, to retract the last-named means from the carton to permit the carton to move away from the lower end of the shape-retaining device and movement of the next carton into position below the lower end of the shape-retaining device.

* * * * *